United States Patent [19]

Roman

[11] 4,026,056

[45] May 31, 1977

[54] TRIGGER RELEASE MECHANISM

[76] Inventor: Gary W. Roman, 9709 Cedar Lake Drive, Louisville, Ky. 40291

[22] Filed: Mar. 22, 1976

[21] Appl. No.: 669,322

[52] U.S. Cl. ..... 42/69 R; 42/42 R

[51] Int. Cl.[2] ..... F41C 19/00

[58] Field of Search ..... 42/69 R, 69 B, 42 R, 42/41

[56] References Cited

UNITED STATES PATENTS

| | | | |
|---|---|---|---|
| 2,027,950 | 1/1936 | Young | 42/69 B |
| 2,033,803 | 3/1936 | Anderson | 42/41 |
| 2,079,039 | 5/1937 | Razee | 42/69 B |
| 2,136,511 | 11/1938 | Jones | 42/69 R |
| 2,233,504 | 3/1941 | Young | 42/69 B |
| 2,406,980 | 9/1946 | Young | 42/41 |
| 2,626,476 | 1/1953 | Miller | 42/69 B |
| 2,654,175 | 10/1953 | Hanser | 42/69 B |
| 3,791,061 | 2/1974 | Tirone | 42/41 |
| 3,808,724 | 5/1974 | Linde | 42/42 R |
| 3,903,631 | 9/1975 | Vesamaa | 42/41 |

*Primary Examiner*—Charles T. Jordan

*Attorney, Agent, or Firm*—Wm. R. Price

[57] ABSTRACT

A trigger release mechanism is disclosed which changes the action of the factory trigger mechanism by moving the pivot point of the trigger forward through the use of an extension fork extending forwardly of the factory trigger base. In normal movement, with the factory pivot point, as the trigger is pulled rearward, the trigger actuated end of the sear is pulled downwardly, lifting the hammer engaging end of the sear to disengage the hammer and allow the hammer to fall. However, by changing this pivot point, the sear catch of the trigger actuated linkage indexes on the trigger actuated end of the sear only when the trigger is pulled backwardly. Spring tension from a spring plunger absorbs the potential energy caused by the upward movement of the trigger base. Upon release of finger pressure on the trigger, the spring loaded plunger releases kinetic energy to furnish the downward thrust to force the trigger actuated end of the sear downwardly so as to raise the hammer engagement end of said sear out of engagement with the hammer and release same.

5 Claims, 4 Drawing Figures

TRIGGER RELEASE MECHANISM

FIELD OF THE INVENTION

This invention relates generally to firearms and more particularly to the firing mechanism of a shotgun. Still more specifically, this invention relates to a trigger release mechanism which allows the gun to fire only upon release of finger pressure on the trigger. Still more specifically, this invention relates to a trigger release mechanism for a gun without the use of an additional trapping sear or pin as have been encounted with trigger release mechanisms known in the prior art.

DESCRIPTION OF THE PRIOR ART

Trigger release mechanisms are well known and are those which fire on a forward movement of the trigger after it has been pressed to its full rear position in contrast to the standard gun which fires on a rearward pull. However, the trigger release mechanisms known in the art have utilized a trapping sear which allows the factory sear to release the hammer and a second sear to trap the hammer prior to firing. Because of this, there is the danger of a misfire in that if the trapping sear should fail, the gun may fire unexpectedly. Typical trigger release mechanisms with the additional trapping sear have been disclosed in U.S. Pat. Nos. 2,027,950 to C. A. Young; 2,233,504 to C. A. Young; 2,406,980, C. A. Young; 2,406,981, C. A. Young; 2,033,803, T. L. Anderson; 2,136,511 to P. L. Jones; 2,513,162 to J. H. Gartner; 3,791,061 to John C. Tirone; and 2,079,034 to R. Razee.

SUMMARY OF THE INVENTION

According to this invention, a trigger release mechanism is provided which does not utilize a separate pin, or a separate trapping sear, but allows the use of the normal factory sear and hammer mechanism through the provision of an elongated trigger base with a forward pivot point. This apparatus is applicable to overhead sears having a trigger actuated end and a hammer engaging end. Additionally, there is provided, according to this invention, a spring-loaded plunger. This plunger is mounted in position to absorb the potential energy caused by the upward pivoting of the rear portion of the elongated trigger base upon rearward movement of the trigger and to release kinetic energy upon release of finger pressure on the trigger. This provides downward thrust for pushing the trigger actuated end of the overhead sear downwardly, thus raising the hammer engaging end out of engagement with the hammer and allowing it to fire.

BRIEF DESCRIPTION OF THE DRAWINGS

The invention can be better understood by reference to the drawings in which.

DESCRIPTION OF THE PREFERRED EMBODIMENT

Figure 1:
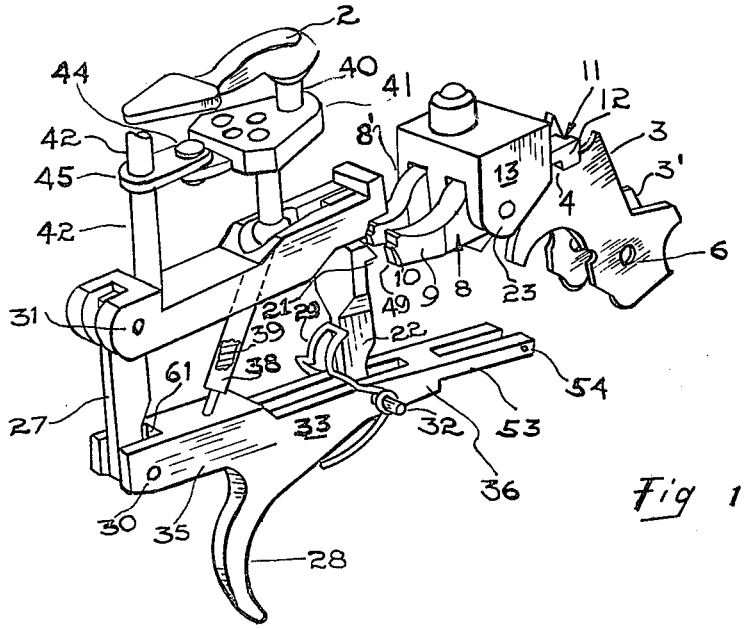
FIG. 1 is a view in perspective of the trigger release mechanism of the invention, mounted on the Remington 320 over-under shotgun.

Referring now to the drawings, it will be noted that the mechanism illustrated has been shown as mounted on the Remington 3200 over-under shotgun which is described and claimed fully in U.S. Pat. No. 3,808,724. Referring to the drawing, receiver 1 for the firing mechanism contains at the top a selector lever 2 specifically designed for the 3200 shotgun to change the single trigger mechanism from upper to lower barrels by the use of a sear 8 or 8' respectively. The hammer for either the upper or lower barrel is illustrated by numerals 3 or 3' and contains a hammer notch 4 for engagement fo the tab 12 of the hammer engaging end of the sear which is shown in engagement in FIGS. 1, 2, and 3. The hammer contains a pivot 6 and is powered by a strong hammer spring 40. The overhead sears, 8 and 8' respectively are pivotably mounted by pin 7 in sear housing 13. The sear 8 consists of a trigger actuated end 9 containing a step 10 for engagement with the trigger actuated linkage, and a hammer engaging end 11 which, as noted, contains a downwardly extending tab 12 for engagement with the notch 4 of hammer 3.

The trigger actuated mechanism of the 3200 Remington shotgun consists essentially of a four bar linkage. This consists primarily of a front vertical connecting linkage 22, a rear vertical connecting linkage 27, an elongated trigger base 33 for the trigger 28 and an upper horizontal connecting linkage (referred to in the U.S. Pat. No. 3,808,724, as a selector block) 18. It will be noted that the front vertical connecting linkage 22 is pivotably connected to the base of the trigger mechanism by pin 32 at the bottom and is pivotably connected at the top to the horizontal connecting linkage 18 by pin 34. Likewise, the rear vertical connecting linkage 27 is pivotably fitted in slot 61 of the rear portion 35 of the trigger base by means of pin 30 and at the top through the rear portion of the upper horizontal connecting linkage 18 by pin 31. The normal pivot point for the elongated trigger base 33 is shown in phantom lines in FIG. 2 as 26. The normal firing procedure described in U.S. Pat. No. 3,808,724, is through the use of the spring 29 wrapped around pin 32 which upon the application of finger pressure on trigger 28 pushes the front connecting vertical linkage 22 forwardly so that the tooth 21, engages with step 10 of the trigger actuated end 9 of sear 8 pushing it downwardly and pushing the hammer engaging end 11 of sear 8 upwardly so that the tab 12 comes out of engagement with hammer notch 4. It will be noted that it is necessary to overcome the pressure of coil spring 63 in order to disengage the tab 12 from the hammer notch 4.

Referring now to the present modification of this invention, the old pivot point 26 is no longer used. There has been added an extension to the front portion 36 of the elongated trigger base in the form of a fork 53

Figure 3:
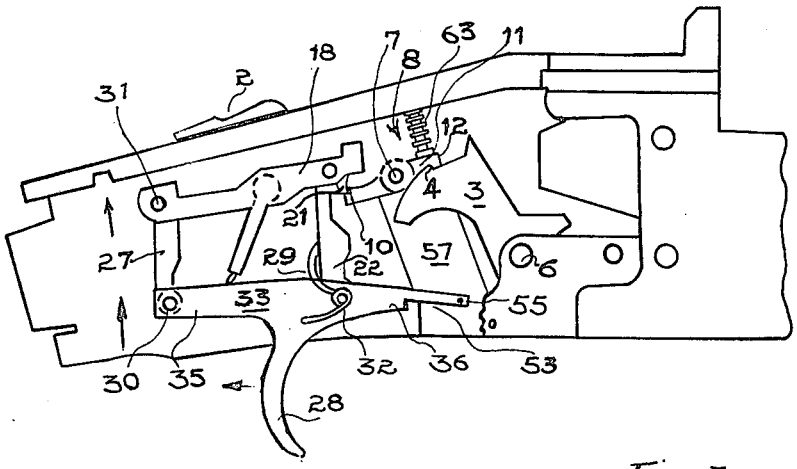
FIG. 3 is a fragmentary side elevational view with portions omitted for clarity, illustrating the trigger actuated mechanism in engagement with the trigger actuated end of the overhead sear upon application of pressure to the trigger to move it reasonably.
Figure 4:
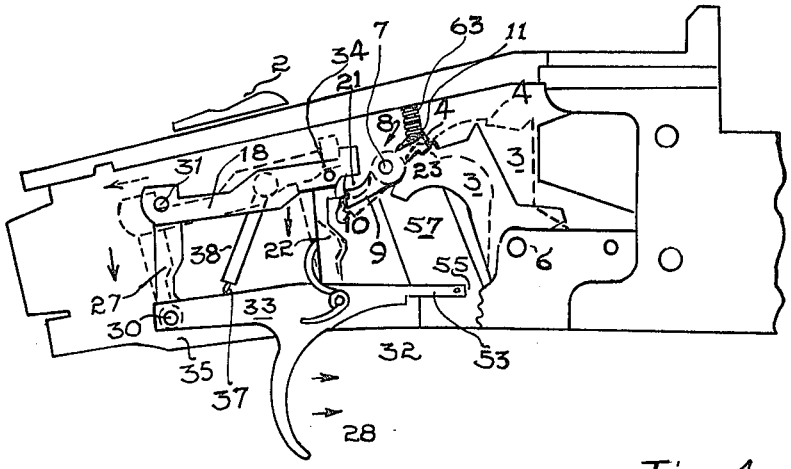
FIG. 4 is a fragmentary side elevation, illustrating the position of the trigger actuated mechanism upon release of the pressure from the trigger, and illustrating in full lines the downward thrust of the trigger actuated mechanism on the trigger actuated end of the overhead sear, pushing it downwardly and pivoting the hammer engaging end of said overhead sear upwardly to release the hammer, and illustrating in phantom lines the position of the mechanism and of the hammer in firing position.

/hich straddles web 57 of the gun. It will be noted that ı FIG. 1, that the fork 53 contains a hole 54 at its distal nd for provision of a pin 55 which extends through /eb 57. Therefore, as can be seen in phantom lines in 'IG. 2, the tooth 21 is almost in engagement with the amming surface 49 of the end of the trigger actuated nd 9 of the overhead sear 8 and is slightly below the tep 10. Thus, when finger pressure is applied to the rigger 28 as illustrated diagramatically in FIG. 3, the ear end 35 of the trigger base 33 moves upwardly. This ushes the rear vertical connecting linkage 27 up-/ardly as well as the rear portion of the horizontal onnecting linkage 18 upwardly. This action pushes the ront vertical connecting linkage 22 upwardly and for-/ardly so that the tooth 21 comes into engagement /ith the step 10 of the trigger actuated end 9 of over-ead sear 8. A spring loaded plunger 37 having a casing 8 and spring 39 is mounted at the bottom in a depres-ion located in the rear portion 35 of the trigger base nd at the top toward the front portion of the upper orizontal connecting member 18. The spring 39, of he spring loaded plunger 37 absorbs the potential nergy caused by the upward and forward movement of he trigger actuated mechanism formed by the four bar nkage. When, as shown in FIG. 4, the finger pressure ; released, the spring member 29 pushes the front nkage 22 downwardly. At this point, the spring mem-er 39, releases kinetic energy pushing the plunger 37 ownwardly and pushing the rear of the trigger base nd the connecting linkages downwardly so as to push he trigger actuated end 9 of the overhead sear down-/ardly. This action raises the hammer engaging tab 12 f the hammer engaging end 11 of overhead sear 8 out f engagement with the hammer notch 4 against the iasing pressure of compression spring 63, thus releas-ıg the hammer. As is shown in phantom lines in FIG. ', as the hammer is pushed forwardly by the strong ammer spring 40, the camming surface 23 of the ham-ıer 3 engages the undersurface of overhead sear 8 and ıushes the trigger engaging end still further down-/ardly.

As is indicated in some detail in U.S. Pat. No. ,808,724, the vertical connecting members 22 and 27 espectively, fit into rather large slots 61 of the trigger ıase and are movable laterally so that the tooth 21 of he front vertical connecting linkage 22 will fit into one ır the other sears 8 or 8' to engage hammers 3 or 3' espectively.

Figure 2:
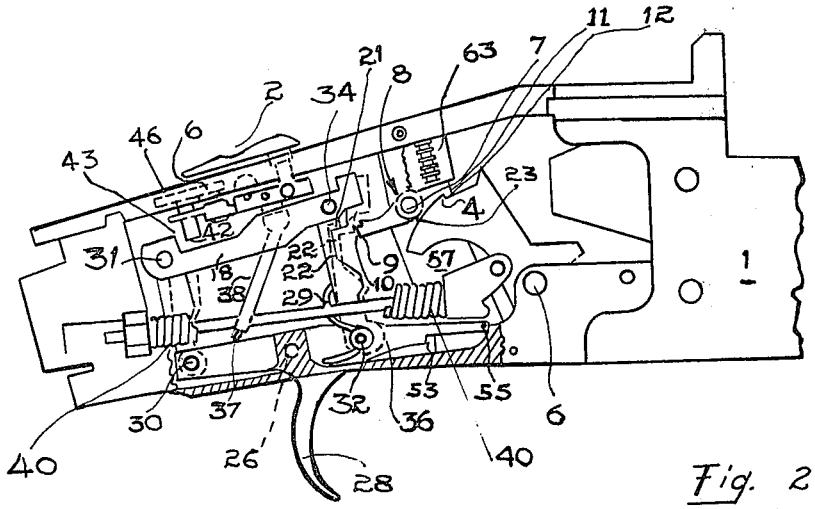
FIG. 2 is a fragmentary side elevation showing the mechanism of this invention and illustrating the trigger actuated mechanism in safety position in full lines and in ready setting in phantom lines.

The selector lever has a neutral or safe position as is lustrated in FIGS. 1 and 2 wherein the selector block r upper horizontal connecting member 18 is cammed ackwardly so that the front connector linkage 22 can-ot contact sear 8. This is accomplished by means of a ɔggle link 45 which pivots from the tail end of the ɔggle bock 41 about pivot pin 44. Pin 42 extends from he rearward end of the toggle link 45 and engages with he abutment face 43 of the selector block or upper orizontal connecting linkage 18 when the selector evel 2 approaches a neutral position. When the selec-ɔr lever is put on safe, the pin 42 contacts the abut-ıent face 43 and forces the selector block 18 back-/ardly to disengage the engagement tooth 21 from the ear 8. As the selector lever 2 is flipped to either of its elective positions, the pin 42, moves forward away rom the selector block 18 allowing it to come forward nd thus permit the connector tooth 21 to engage ei-her of the sears 8 or 8'. Toggle link 45 arcs in the pposite direction to the movement of the selector lever 2. This occurs as a result of pin 42. Pin 42 extends into slot 16 of the receiver and has a slide block 46 at its upper end (See FIG. 2). Slide block 46 slides forwardly and backwardly in slot 16 causing the rearward end of the toggle link 45 to do the same. This restraint upon the rearward portion of the toggle link forces the link to pivot about the pivot pin 44 in the opposite sense to the toggle block 41 and selector lever 2.

As a result, the modifications shown in this invention does not affect the selector mechanism disclosed in the U.S. Pat. No. 3,808,724, but allows the use of this system to reset the trigger release system. This eliminates one of the major problems with all break action guns in that the wear or the action created by opening the gun to reset the release system is eliminated. All that is required with the modification of this system is to reset the system by placing the selector lever on safety. This clears the system. Thereafter the firing order is selected and the gun is ready for use.

While this invention has been illustrated for use with the 3200 Remington over-under shotgun, it has been adapted to other weapons such as the Beretta Mark II and the Browning O/U. It is applicable to all over head sear operated mechanisms which have a hammer engaging and a trigger actuated end and which are pivoted for movement to engage or release the hammer. What is involved is the provision of a forward pivot point, pushing the rear of the trigger base upwardly and a spring means for absorbing the potential energy caused by the upward movement of the base and providing thrust downwardly to push the trigger actuated end of the overhead sear downwardly and thus disengage the hammer engaging end from the hammer allowing same to fire.

Many modifications will occur to those skilled in the art from the detailed description hereinabove given and such is meant to be exemplary in nature and nonlimiting except so as to be commensurate in scope with the appended claims.

I claim:

1. A trigger mechanism, for use with a firearm device, having a breech, a pull trigger, said trigger having an elongated base, a firing pin disposed on said breech, hammer means for striking said pin, an overhead sear, said sear having a hammer engaging end and a trigger actuated end and being pivotably mounted for overhead engagement of said hammer engaging end with said hammer, a trigger actuated linkage in operative relation with said pull trigger for moving the trigger actuated end of said overhead sear downwardly and simultaneously raising said hammer engaging end of said sear upwardly and out of engagement with said hammer;

the improvement in said trigger release mechanism, which comprises,

A. pivot means for said pull trigger, said pivot means being operatively connected to the front portion of said elongated base of said trigger for raising the rear portion of said trigger base upwardly and forwardly responsive to application of pressure on said trigger and for moving said trigger actuated linkage upwardly and forwardly for engagement with said trigger actuated end of said sear; and B. a spring-loaded plunger, mounted in operative relation with said rear portion of said elongated base of said trigger and responsive to movement of said trigger for:

1. absorbing the potential energy caused by the upward movement of said trigger base upon application of finger pressure to said trigger, and
2. for releasing kinetic energy upon release of pressure on said trigger to provide downward thrust against said trigger base and said trigger actuated linkage and to push the trigger actuated end of said sear downwardly so as to raise the hammer engaging end of said sear out of engagement with said hammer.

2. A trigger release mechanism, as defined in claim 1, in which:

A. said trigger actuated linkage comprises first and rear vertical connecting linkages, pivotably connecting at the bottom to the front and rear of said elongated trigger base and B. an upper horizontal connecting member pivotably connecting at its front and rear ends to said front and rear vertical connecting linkages respectively.

3. A trigger release mechanism, as defined in claim 2, in which

A. said spring loaded plunger is mounted at the top to said horizontal connecting member and at the bottom to the rear portion of said trigger base.

4. A trigger release mechanism, as defined in claim 2, in which said front vertical linkage contains an engagement tooth for engagement with said trigger actuated end of said sear.

5. A trigger release mechanism, as defined in claim 1, in which

A. said pivot means is in the form of a fork extending forwardly of said elongated trigger base and B. a pivot pin for said pivot means.

* * * * *